US008424124B2

(12) United States Patent
Lee et al.

(10) Patent No.: US 8,424,124 B2
(45) Date of Patent: Apr. 23, 2013

(54) SEAT OPERATED TOILET WITH MOVABLE WATER STORAGE TANK

(76) Inventors: Ming Shan Lee, Hong Kong (CN); Ho Fan Lee, Hong Kong (CN)

( * ) Notice: Subject to any disclaimer, the term of this patent is extended or adjusted under 35 U.S.C. 154(b) by 615 days.

(21) Appl. No.: 12/158,690

(22) PCT Filed: Jul. 10, 2006

(86) PCT No.: PCT/CN2006/001614

§ 371 (c)(1),
(2), (4) Date: Jan. 26, 2011

(87) PCT Pub. No.: WO2007/071135

PCT Pub. Date: Jun. 28, 2007

(65) Prior Publication Data

US 2011/0107505 A1 May 12, 2011

(30) Foreign Application Priority Data

Dec. 21, 2005 (CN) ..... 2005 1 0132068

(51) Int. Cl.
*E03D 1/18* (2006.01)

(52) U.S. Cl.
USPC ..... 4/338; 4/339; 4/366

(58) Field of Classification Search ..... 4/324, 338, 4/339, 366, 405, 408, 409
See application file for complete search history.

(56) References Cited

U.S. PATENT DOCUMENTS 279,183 A * 6/1883 Prosser ..... 4/338
5,319,810 A * 6/1994 Metzger ..... 4/408

FOREIGN PATENT DOCUMENTS

CN 2625459 Y * 2/1995
CN 2188604 Y * 5/1995
GB 191000391 A * 1/1910

OTHER PUBLICATIONS

Machine Translation of CN 2625459Y.*
Machine Translation of CN 2188604 Y.*
English Translation of the Written Opinion of the Internation Searching Authority for PCT/CN2006/001614.*

* cited by examiner

*Primary Examiner* — Gregory Huson
*Assistant Examiner* — Erin Deery

(57) ABSTRACT

A multifunctional toilet comprises a water storage device having a guide rail, a toilet seat and an arm assembly. The water storage device is provided with a water tank having a water inlet and a water outlet. At the water inlet is provided an inlet valve having a float ball, and at the water outlet is provided an outlet valve. The opening and closing of the inlet valve is controlled by a controller. The opening and closing of the outlet valve is controlled by a rope. When the water tank moves to its lowest position, the controller will close the inlet valve, and the rope will open the outlet valve. At the water outlet outside the water tank is provided an expansion discharge pipe. Such a multifunctional toilet is simple in structure and has the advantage of automatically flushing the toilet without the use of electricity.

11 Claims, 7 Drawing Sheets

SEAT OPERATED TOILET WITH MOVABLE WATER STORAGE TANK

BACKGROUND OF THE INVENTION

1. Field of the Invention

The present invention relates to a flushing member for a toilet, and more particularly to a multifunctional toilet which comprises a vertically movable water storage device with a guide rail, a toilet seat and an arm assembly. The arm assembly is provided with a hinge portion and has two ends connected to the water storage device and the toilet seat, respectively. The water storage device is provided with a water tank having a water inlet and a water outlet. At the water inlet inside the water tank is provided an inlet valve having a float ball, and at the water outlet inside the water tank is provided an outlet valve.

2. Description of the Prior Art

An automatic non-electrical toilet flushing device is disclosed in Chinese Pat. No. CN2625459, which comprises a water tank movable up and down, a toilet seat, a toilet bowl, an arm, a water inlet and a water outlet. The arm is provided with a hinge portion and has one end connected to the water tank and the other end connected to the toilet seat. The toilet seat is disposed on the toilet bowl. Before the water tank is full, the moment of force applied by the water tank to the hinge portion is greater than that applied by the toilet seat to the hinge portion. Through the up and down motion of the arm, the water tank and the toilet seat of the toilet are interchangeably brought into an imbalanced state. Before the water tank is full, the moment of force applied by the water tank to the hinge portion is smaller than that applied by the toilet seat to the hinge portion. When using the toilet, the user applies a force to make the toilet seat parallel to the toilet bowl, thus pouring water into the water tank. After using the toilet, since the moment of force applied by the water tank to the hinge portion is greater than that applied by the toilet seat to the hinge portion, the water tank will move downward and open an outlet valve, thus achieving the effects of automatically lifting up the toilet seat and flushing the toilet without the use of electricity. The automatic non-electrical toilet flushing device is convenient to use, environmental friendly and can prevent disease infection. However, how the movable water tank operates, and the structures of the water tank and the toilet bowl are not described in detail. Moreover, the current automatic toilets are all electronically controlled, so that they are high maintenance.

The present invention has arisen to mitigate and/or obviate the afore-described disadvantages.

SUMMARY OF THE INVENTION

The primary objective of the present invention is to provide a multifunctional toilet which operates through the up and down motion of an arm assembly.

The present invention has the advantages of automatically flushing the toilet and supplying water without the use of electricity.

The multifunctional toilet of the present invention comprises a vertically movable water storage device with a guide rail, a toilet seat and an arm assembly with one end connected to a hinge portion of the water storage device and the other end connected to the toilet seat. The water storage device is provided with a water tank having a water inlet and a water outlet. At the water inlet inside the water tank is provided an inlet valve having a float ball, and at the water outlet inside the water tank is provided an outlet valve. The opening and closing of the inlet valve is controlled by a controller. The opening and closing of the outlet valve is controlled by a rope with one end fixed and the other end connected to the outlet valve. The rope has such a length that when the water tank moves to its lowest position, the rope will open the outlet valve. At the water outlet outside the water tank is provided an expansion discharge pipe.

The arm assembly is a double arm structure and comprises two triangular arms. In an upper portion of each triangular arm is defined a through hole, a positioning shaft is inserted in and is partially protruded out of the through holes of the triangular arms, and two bearings are mounted on both ends of the positioning shaft. In a lower portion of each triangular arm is defined a pivot point in the form of a hole in which the bearing is inlaid.

The arm assembly can also be designed to be a single arm, which comprises one triangular arm. The through hole is defined in the upper portion of the triangular arm for insertion of the positioning shaft. The positioning shaft is partially protruded out of the through hole of the triangular arm, and the bearings are mounted on both ends of the positioning shaft. The pivot point is defined in the lower portion of the triangular arm in the form of a hole in which the bearing is inlaid.

In a bottom of the triangular arm is defined a penetrating hole for insertion of a fixing shaft. The toilet seat is movably mounted on the fixing shaft. At a lower portion of a front end of the triangular arm is provided a lug.

The toilet seat can also be directly connected to the lower portion of the front end of the triangular arm.

The water storage device further comprises a water tank support and a base. The water tank support is defined with a U-shaped groove in a bottom of which is defined a through hole. The water tank is located in the U-shaped groove. At a lower surface of the U-shaped groove is provided two parallel lateral plates, and each lateral plate is defined with a slot. The positioning shaft of the arm assembly is inserted in the slots, and the bearings of the positioning shaft are abutted against the lower surface of the U-shaped groove. The base is also defined with a U-shaped groove in a bottom of which is defined a through hole. The U-shaped groove of the water tank support is located in the U-shaped groove of the base. A horizontal shaft is inserted in one lateral plate of the U-shaped groove, and two bearings are mounted on the horizontal shaft.

The water storage device can also comprise the base. The two parallel lateral plates are provided at a lower surface of the water tank, and the slot is defined in each lateral plate. The positioning shaft of the arm assembly is inserted in the slots, and the bearings of the positioning shaft are abutted against the lower surface of the water tank. The bottom defined with a through hole is provided at the base, and the water tank is located at the bottom of the base. The horizontal shaft is inserted in a lateral board of the base, and the bearings are mounted on the horizontal shaft.

The guide rail is a linear guide rail and its sliding block is directly fixed at an outer surface of the water tank.

The structure of the guide rail is characterized in that: at one lateral board of the water tank support is provided two ears, and on an inner surface of each ear is provided a bearing. At one lateral board of the base is provided two vertical guide grooves in which the bearings of the ears are to be slidably moved.

The water storage device is further provided with a delay device for delaying the rise of the toilet seat, and the delay device includes a spring, a positioning ball and a concave. The delay device is located between the movable parts and the stationary parts of the water storage device.

The controller for controlling the inlet valve and the rope are fixed to a horizontal rod.

An opening is defined in a front end of the toilet seat.

The controller comprises a ring defined with an adjusting groove in an upper portion thereof and an opening The multifunctional toilet seat mechanism further comprises a toilet bowl having a water inlet and a discharge outlet. A cylinder defined with a locking groove is protruded out of the water inlet of the toilet bowl.

The water inlet is in communication with an inner ring of a bowl opening, and water is sprayed from a spraying opening defined in a rear surface of the inner ring thereof.

At a front end of the bowl opening is defined a horseshoe-shaped urinary space.

There is a height difference h between the lowermost end of a rear wall of the toilet bowl and a joint of a front wall and a trap.

The trap of the toilet bowl is arc-shaped in cross section

A locking disc is disposed on the discharge pipe. The locking disc is provided with at least two protrusions to be locked in the locking groove of the cylinder, thus tightly connecting the water tank to the toilet bowl.

The opening and closing of the inlet valve of the present invention is controlled by the controller, and the opening and closing of the outlet valve is controlled by the rope with one end fixed and the other end connected to the outlet valve. When the water tank moves to its lowest position, the rope will open the outlet valve. The expansion discharge pipe is disposed at the water outlet outside the water tank, so that when the water tank moves to its lowest position, the water tank is empty and discharges water automatically. When the water tank moves to its topmost position, the water tank is full and is not overflowed. Thereby, the toilet can be flushed automatically after being used simply by sitting on the toilet seat.

The present invention also has the advantages of automatically lifting up the toilet seat, flushing the toilet, and spraying disinfectant solution.

The spraying function of the toilet bowl can reduce stink and prevent the spreading of germs.

The urinary space of the bowl opening and the opening of the toilet seat can prevent cross infection, especially for women.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
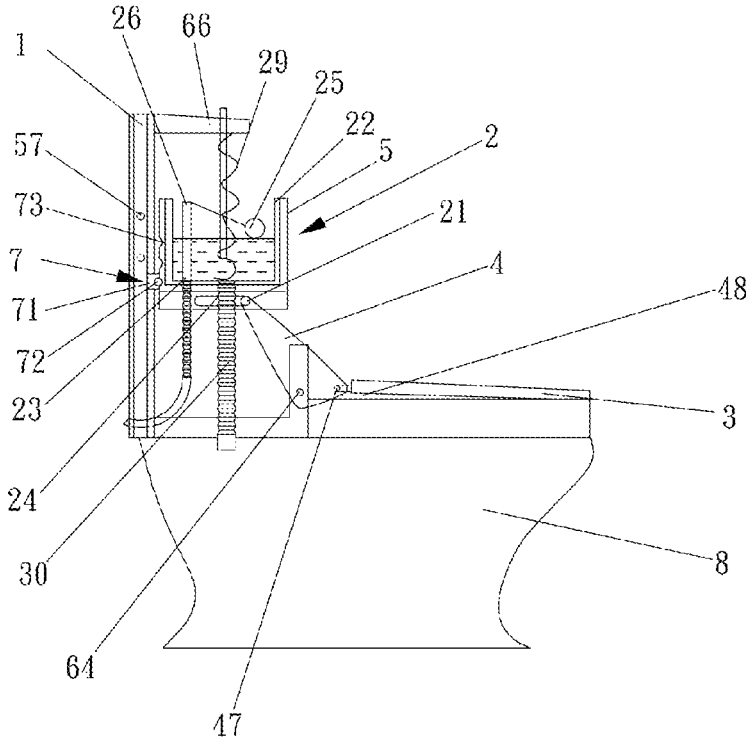
FIG. 1 is an illustrative view showing a water tank moving to its topmost position in accordance with the present invention.
Figure 2:
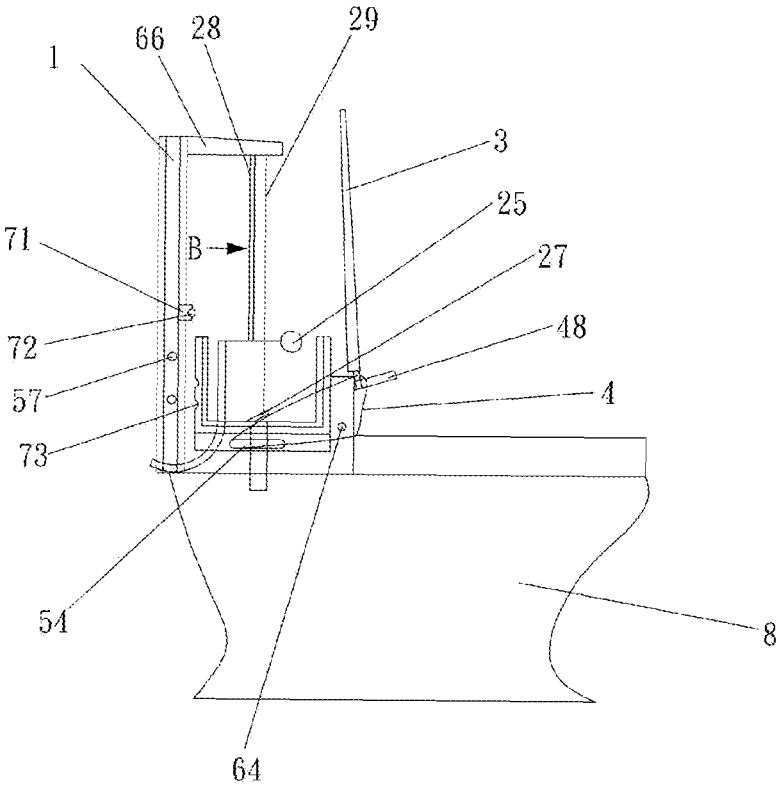
FIG. 2 is an illustrative view showing the water tank moving to its lowest position in accordance with the present invention.

Referring to FIGS. 1 and 2, a multifunctional toilet in accordance with a first embodiment of the present invention comprises a vertically movable water storage device 2 with a guide rail 1, a toilet seat 3, and an arm assembly 4 with one end connected to a hinge portion 21 of the water storage device 2 and the other end connected to the toilet seat 3. The water storage device 2 is provided with a water tank 22 having a water inlet 23 and a water outlet 24. At the water inlet 23 inside the water tank 22 is provided an inlet valve 26 having a float ball 25, and at the water outlet 24 inside the water tank 22 is provided an outlet valve 27. The opening and closing of the inlet valve 26 is controlled by a controller 28 with one end fixed to a horizontal rod 66, and the other end of the controller 28 is a ring 281 having an adjusting groove 282. The adjusting groove 282 is mainly used to adjust the height of the controller 28. At an upper portion of one side of the ring 281 is defined an opening 283 for facilitating the maintenance of the float ball 25 and the inlet valve 26. The opening and closing of the outlet valve 27 is controlled by a rope 29 with one end also fixed to the horizontal rod 66 and the other end connected to the outlet valve 27. The horizontal rod 66 is detachably fixed at the topmost of a base 6 of the water tank 22 by a screw 67. When the water tank 22 moves to its lowest position, the controller 28 will close the inlet valve 26, and the rope 29 will open the outlet valve 27. At the water outlet 24 outside the water tank 22 is provided an expansion discharge pipe 30. With the interaction of the controller 28 and the rope 29, when the water tank 22 moves to its lowest position, the inlet valve 26 is closed, and the outlet valve 27 is opened, such that the water tank 22 is empty. When the water tank 22 moves upward to its topmost position, the controller 28 and the rope 29 are loosened so that the outlet valve 27 is closed and the float ball 25 of the inlet valve 26 falls, thus opening the inlet valve 26 to pour water into the water tank 22. When the water tank 22 is full, the inlet valve 26 will be closed again with the rise of the float ball 25, so as to prevent the overflow of the water tank 22. It can be seen from FIGS. 1 and 2 that the water storage device 2 is further provided with a delay device 7 for delaying the rise of the toilet seat 3, and the delay device 7 includes a spring 71, a positioning ball 72 and a concave 73. The delay device 7 is located between the movable parts (the water tank 22 and a water tank support) and the stationary parts (the base 6) of the water storage device 2. In order to prevent the water tank 22 from rising suddenly after the user leaves the toilet seat 3 and causing uncomfortableness to the user, the positioning ball 72 of the delay device 7 will be engaged in the concave 73 with the aid of the spring 71, so as to delay the rise of the toilet seat 3 for 3-5 seconds.

Figure 3:
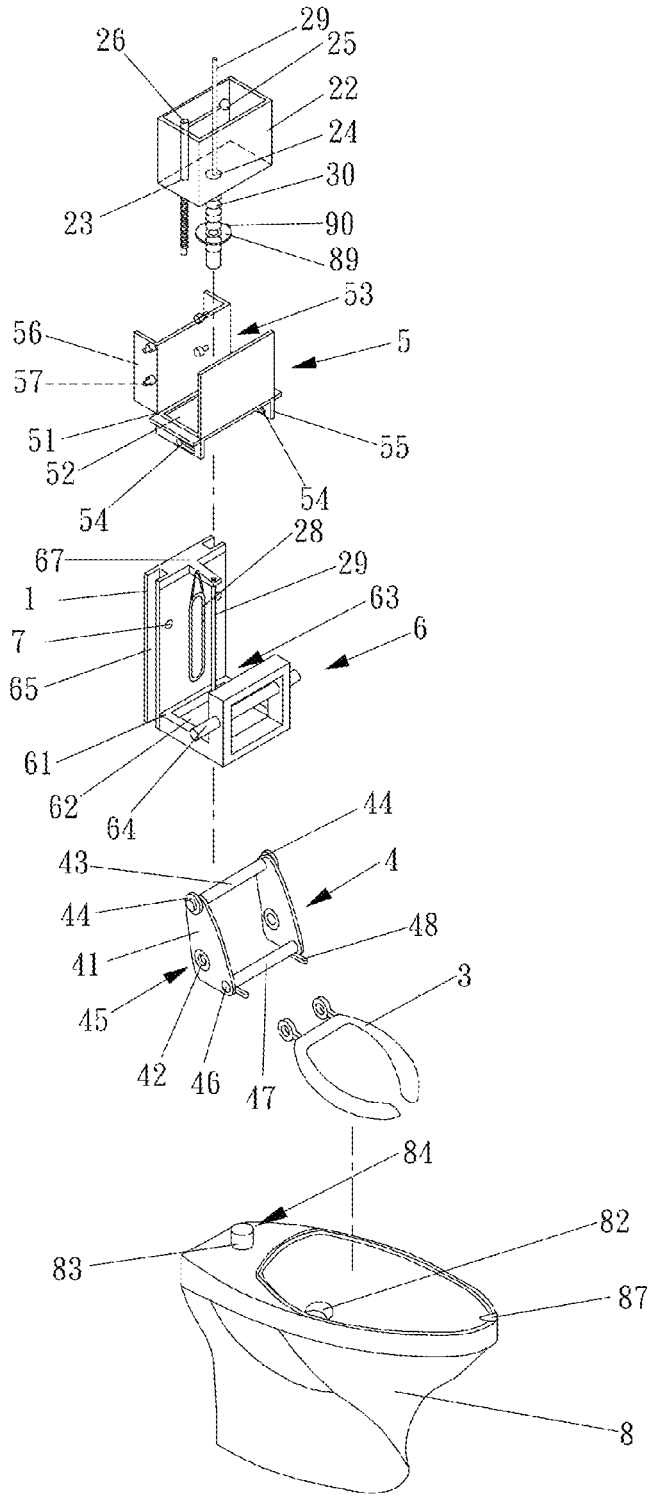
FIG. 3 is an exploded view of a multifunctional toilet in accordance with a first embodiment of the present invention.

Referring to FIG. 3, an exploded view of FIGS. 1 and 2 is shown, the water storage device 2 further comprises the water tank support 5 and the base 6. The water tank support 5 is defined with a U-shaped groove 53 in a bottom 51 of which is defined a through hole 52. The water tank 22 is located in the U-shaped groove 53. At a lower surface of the U-shaped groove 53 is provided two parallel lateral plates 55, and each lateral plate 55 is defined with a slot 54. A positioning shaft 43 of the arm assembly 4 is inserted in the slots 54, and two bearings 44 of the positioning shaft 43 are abutted against the lower surface of the U-shaped groove 53. The base 6 is also defined with a U-shaped groove 63 in a bottom 61 of which is defined a through hole 62. The U-shaped groove 53 is located in the U-shaped groove 63. A horizontal shaft 64 is inserted in one lateral plate of the U-shaped groove 63, and two bearings 42 are mounted on the horizontal shaft 64. At one lateral board of the water tank support 5 is provided two ears 56, and on an inner surface of each ear 56 is provided a bearing 57. At one lateral board of the base 6 is provided two vertical guide grooves 65 in which the bearings 57 of the ears 56 are to be slidably moved.

Figure 4:
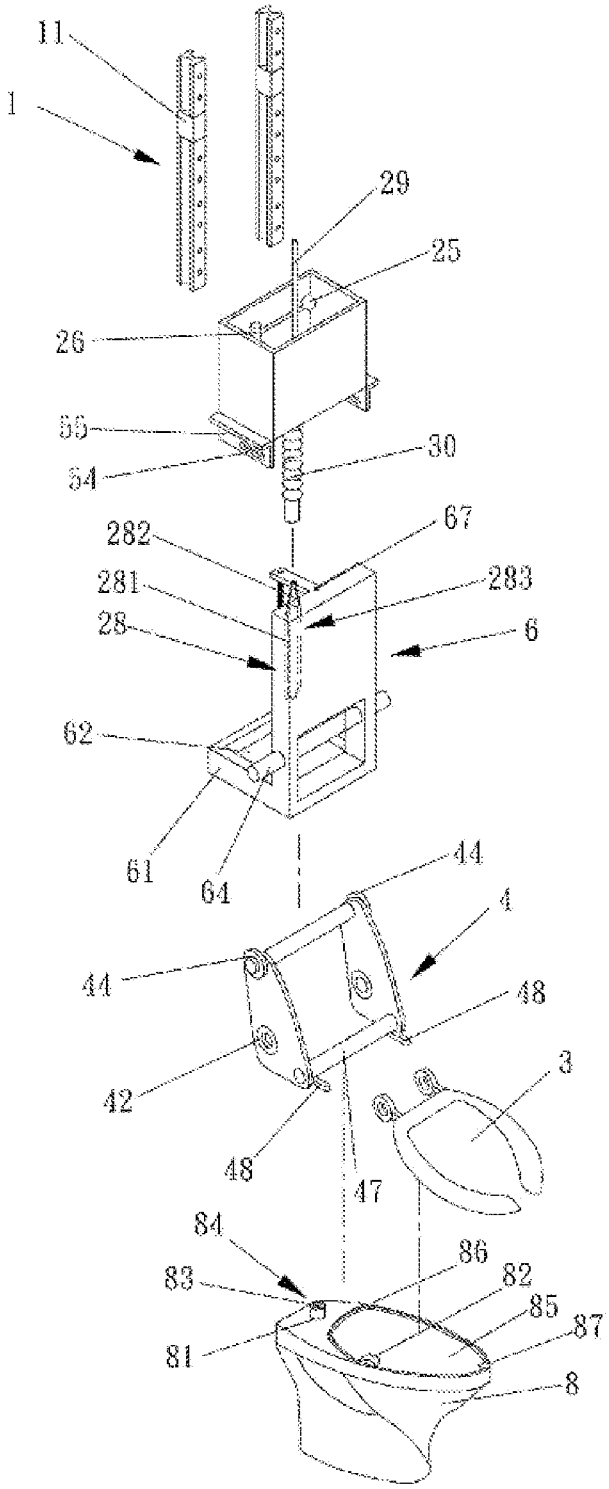
FIG. 4 is an exploded view of the multifunctional toilet in accordance with a second embodiment of the present invention.

Referring to FIG. 4, an exploded view of a second embodiment of the present invention is shown, the water storage device 2 comprises the base 6. The two parallel lateral plates 55 are provided at a lower surface of the water tank 22, and the slot 54 is defined in each lateral plate. The positioning shaft 43 of the arm assembly 4 is inserted in the slots 54, and the bearings 44 of the positioning shaft 43 are abutted against the lower surface of the water tank 22. The bottom 61 defined with the through hole 62 is provided at the base 6, and the water tank 22 is located at the bottom 61. The horizontal shaft 64 is inserted in a lateral board of the base 6, and the bearings 42 are mounted on the horizontal shaft 64. In the present embodiment, the guide rail 1 is a linear guide rail and its sliding block 11 is directly fixed at an outer surface of the water tank 22.

In the above-mentioned embodiments, the arm assembly 4 is a double arm structure and comprises two triangular arms 41. In an upper portion of each triangular arm 41 is defined a through hole for insertion of the positioning shaft 43. The positioning shaft 43 is partially protruded out of the through holes of the triangular arms 41, and the bearings 44 are mounted on both ends of the positioning shaft 43. In a lower portion of each triangular arm 41 is defined a pivot point 45 in the form of a hole in which the bearing 42 is inlaid.

Figure 5:
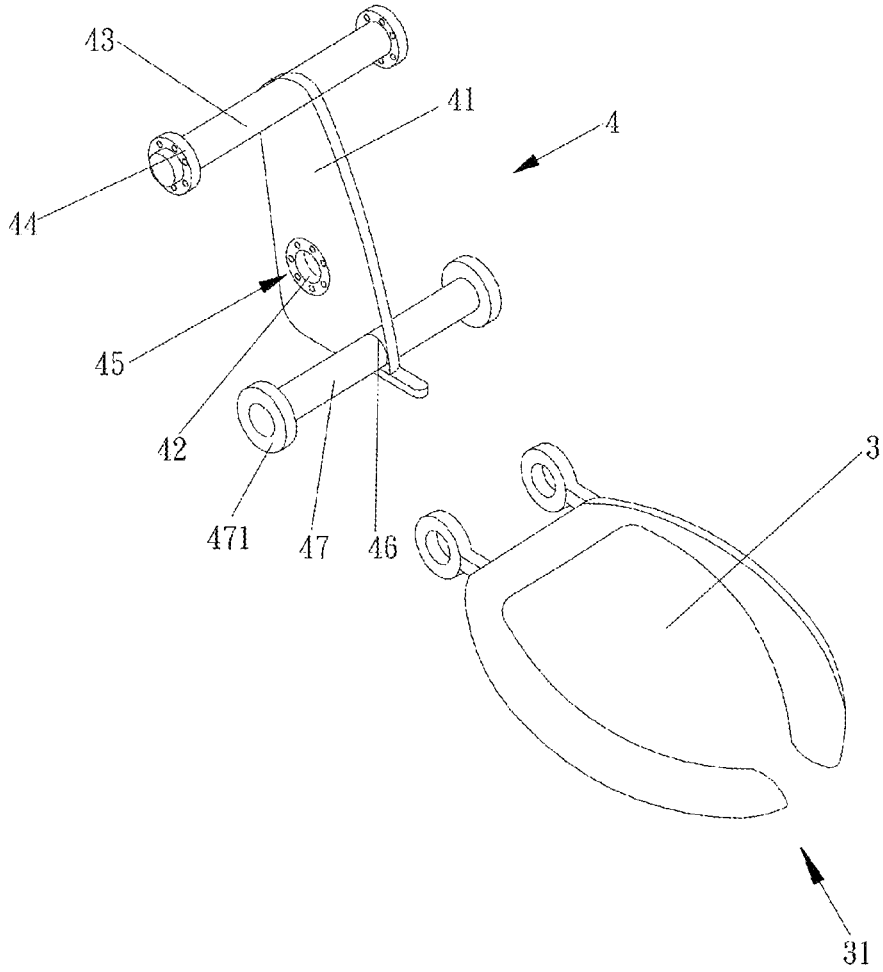
FIG. 5 is a perspective view of a single arm of the multifunctional toilet in accordance with a second embodiment of the present invention.

The above-mentioned arm assembly 4 can also be replaced by a single arm as shown in FIG. 5, which comprises one triangular arm 41. The through hole is defined in the upper portion of the triangular arm 41 for insertion of the positioning shaft 43. The positioning shaft 43 is partially protruded out of the through hole of the triangular arm 41, and the bearings 44 are mounted on both ends of the positioning shaft 43. The pivot point 45 is defined in the lower portion of the triangular arm 41 in the form of a hole in which the bearing 42 is inlaid. Both ends of a fixing shaft 47 are provided with a blocker 471 to prevent the disengagement of the toilet seat 3.

In a bottom of the triangular arm 41 is defined a penetrating hole 46 for insertion of the fixing shaft 47. The toilet seat 3 is movably mounted on the fixing shaft 47. At a lower portion of a front end of the triangular arm 41 is provided a lug 48 which is located under the toilet seat 3 and is mainly provided for lifting the toilet seat 3 when the water tank 22 moves downward. After rising to a certain height with the aid of the lug 48, the toilet seat 3 can move further upward a distance by inertia and then leans against an outer tank (not shown) of the water storage device 2.

The toilet seat 3 can also be directly connected to the lower portion of the front end of the triangular arm 41 without using the fixing shaft 47. An opening 31 can be defined in a front end of the toilet seat 3.

Figure 6:
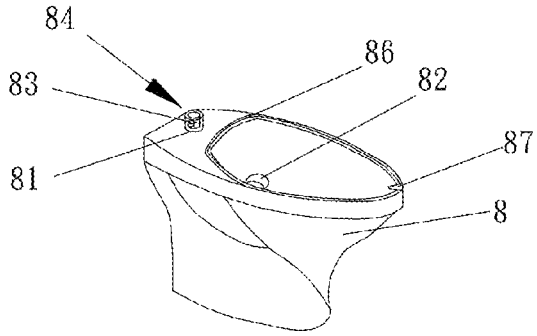
FIG. 6 is a perspective view of a toilet bowl of the multifunctional toilet in accordance with a second embodiment of the present invention.
Figure 7:
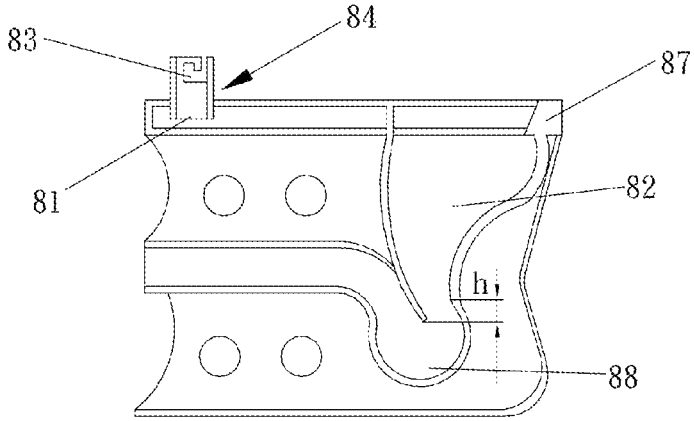
FIG. 7 is a cross sectional view of the toilet bowl of the multifunctional toilet in accordance with a second embodiment of the present invention.

Referring to FIGS. 6 and 7, the multifunctional toilet seat mechanism further comprises a toilet bowl 8 having a water inlet 81 and a discharge outlet 82. A cylinder 84 defined with a locking groove 83 is protruded out of the water inlet 81 of the toilet bowl 8.

The water inlet 81 is in communication with an inner ring of a bowl opening 85, and water is sprayed from a spraying opening 86 defined in a rear surface of the inner ring thereof. The spraying opening 86 is in the form of a groove for spraying water to flush the night soil out of the discharge outlet 82, and the water sprayed from the spraying opening 86 can cover the discharge outlet 82 so as to cover the stink of the night soil. At a front end of the bowl opening 85 is defined a horseshoe-shaped urinary space 87 to prevent the user's urinary organ from contacting the toilet bowl 8 during defecation and causing cross infection.

There is a height difference h between the lowermost end of a rear wall of the toilet bowl 8 and a joint of a front wall and a trap 88, and the trap 88 is arc-shaped in cross section in such a manner that the night soil can be quickly and completely discharged out of the toilet bowl 8. In order to provide an airtight connection between the movable water tank 22 and the toilet bowl 8, a locking disc 89 is disposed on the discharge pipe 30. The locking disc 89 is provided with at least two protrusions 90 to be locked in the locking groove 83 of the cylinder 84, so as to compress the expansion discharge pipe 30 in the cylinder 84 of the toilet bowl 8, thus tightly connecting the water tank 22 to the toilet bowl 8.

Figure 8:
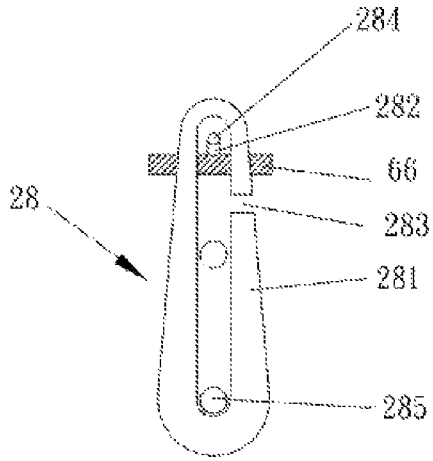
FIG. 8 is an amplified view of a controller of FIG. 2.

Referring to FIG. 8, an amplified view of the controller 28 is shown, the controller 28 comprises the ring 281 having the adjusting groove 282 in an upper portion thereof for adjusting the height of the ring 281. The opening 283 is defined in one side of the ring 281. The controller 28 is fixed on the horizontal rod 66 by a screw 284. In the adjusting groove 282 is provided a link rod 285 which is connected to the float ball 25 and can be moved up and down.

Figure 9:
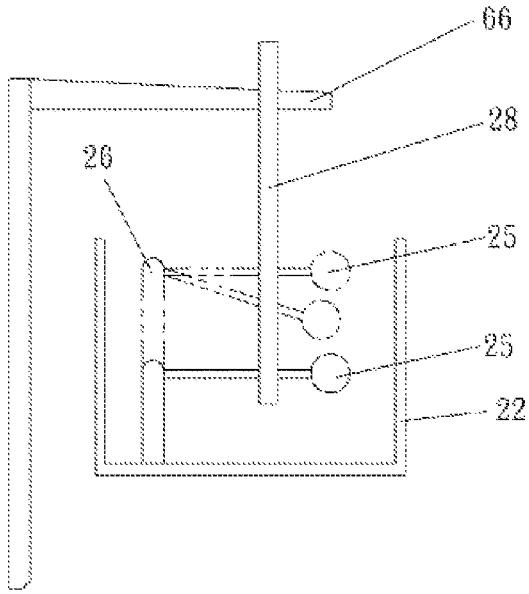
FIG. 9 is an illustrative view showing the opening and closing conditions of an inlet valve controlled by the controller.

Referring to FIG. 9, the opening and closing conditions of the inlet valve 26 is shown, when the water tank 22 moves to its topmost position and is full, the float ball 25 is located at a horizontal lever. When the water tank 22 moves downward, the outlet vale 27 is slightly opened and the float ball 25 falls, thus pouring water into the water tank 22. When the water tank 22 moves to its lowest position, the controller 28 will close the inlet valve 26 again, such that the water tank 22 is empty and ready for the next use.

While we have shown and described various embodiments in accordance with the present invention, it should be clear to those skilled in the art that further embodiments may be made without departing from the scope of the present invention.

What is claimed is:

1. A multifunctional toilet, comprising: a vertically movably water storage device with a guide rail, a toilet seat and an arm assembly with one end connected to a hinge portion of the water storage device and the other end connected to the toilet seat, the water storage device being provided with a water tank having a water inlet and a water outlet, at the water inlet inside the water tank being provided an inlet valve having a float ball, at the water outlet inside the water tank being provided an outlet valve;

characterized in that: an opening and closing of the inlet valve is controlled by a controller, an opening and closing of the outlet valve is controlled by a rope with one end fixed and the other end connected to the outlet valve, the rope has such a length that when the water tank moves to its lowest position, the rope will open the outlet valve, and at the water outlet outside the water tank is provided an expansion discharge pipe, wherein the arm assembly is a double arm structure and comprises two triangular arms, in an upper portion of each triangular arm is defined a through hole, a positioning shaft is inserted in and is partially protruded out of the through holes of the triangular arms, both ends of the positioning shaft are provided with a bearing, and in a lower portion of each triangular arm is defined a pivot point in the form of a hole in which a bearing is inlaid.

2. A multifunctional toilet, comprising: a vertically movably water storage device with a guide rail, a toilet seat and an arm assembly with one end connected to a hinge portion of the water storage device and the other end connected to the toilet seat, the water storage device being provided with a water tank having a water inlet and a water outlet, at the water inlet inside the water tank being provided an inlet valve having a float ball, at the water outlet inside the water tank being provided an outlet valve;

characterized in that: an opening and closing of the inlet valve is controlled by a controller, an opening and closing of the outlet valve is controlled by a rope with one end fixed and the other end connected to the outlet valve, the rope has such a length that when the water tank moves to its lowest position, the rope will open the outlet valve, and at the water outlet outside the water tank is provided an expansion discharge pipe, wherein the arm assembly is a single arm and comprises one triangular arm, a positioning shaft is inserted in and is partially protruded out of a through hole of the triangular arm, both ends of the positioning shaft are provided with a bearing, and in a lower portion of the triangular arm is defined a pivot point in the form of a hole in which a bearing is inlaid.

3. The multifunctional toilet as claimed in claim 1, wherein a penetrating hole is defined in a bottom of a triangular arm for insertion of a fixing shaft, the toilet seat is movably mounted on the fixing shaft, and at a lower portion of a front end of the triangular arm is provided a lug.

4. The multifunctional toilet as claimed in claim 2, wherein a penetrating hole is defined in a bottom of a triangular arm for insertion of a fixing shaft, the toilet seat is movably mounted on the fixing shaft, and at a lower portion of a front end of the triangular arm is provided a lug.

5. The multifunctional toilet as claimed in claim 1, wherein the water storage device further comprises a water tank support and a base, the water tank support is defined with a U-shaped groove in a bottom of which is defined a through hole, the water tank is located in the U-shaped groove, at a lower surface of the U-shaped groove is provided two parallel lateral plates, each lateral plate is defined with a slot, a positioning shaft of an arm assembly is inserted in the slots, two bearings of the positioning shaft are abutted against the lower surface of the U-shaped groove, the base is also defined with a U-shaped groove in a bottom of which is defined a through hole, the U-shaped groove of the water tank support is located in the U-shaped groove of the base, and a horizontal shaft is inserted in one lateral plate of the U-shaped groove and is provided with bearings.

6. The multifunctional toilet as claimed in claim 2, wherein the water storage device further comprises a water tank support and a base, the water tank support is defined with a U-shaped groove in a bottom of which is defined a through hole, the water tank is located in the U-shaped groove, at a lower surface of the U-shaped groove is provided two parallel lateral plates, each lateral plate is defined with a slot, a positioning shaft of an arm assembly is inserted in the slots, two bearings of the positioning shaft are abutted against the lower surface of the U-shaped groove, the base is also defined with a U-shaped groove in a bottom of which is defined a through hole, the U-shaped groove of the water tank support is located in the U-shaped groove of the base, and a horizontal shaft is inserted in one lateral plate of the U-shaped groove and is provided with bearings.

7. The multifunctional toilet as claimed in claim 1, wherein the water storage device further comprises a base, two parallel lateral plates are provided at a lower surface of the water tank, each lateral plate is defined with a slot, a positioning shaft of the arm assembly is inserted in the slots, two bearings of the positioning shaft are abutted against the lower surface of the water tank, a bottom defined with a through hole is provided at the base, the water tank is located at the bottom of the base, and a horizontal shaft is inserted in a lateral board of the base and is provided with bearings.

8. The multifunctional toilet as claimed in claim 2, wherein the water storage device further comprises a base, two parallel lateral plates are provided at a lower surface of the water tank, each lateral plate is defined with a slot, a positioning shaft of the arm assembly is inserted in the slots, two bearings of the positioning shaft are abutted against the lower surface of the water tank, a bottom defined with a through hole is provided at the base, the water tank is located at the bottom of the base, and a horizontal shaft is inserted in a lateral board of the base and is provided with bearings.

9. The multifunctional toilet as claimed in claim 1, wherein two ears are provided at one lateral board of a water tank support, on an inner surface of each ear is provided a bearing, and at one lateral board of a base is provided two vertical guide grooves in which the bearings of the ears are to be slidably moved.

10. The multifunctional toilet as claimed in claim 2, wherein two ears are provided at one lateral board of a water tank support, on an inner surface of each ear is provided a bearing, and at one lateral board of a base is provided two vertical guide grooves in which the bearings of the ears are to be slidably moved.

11. A multifunctional toilet, comprising: a vertically movably water storage device with a guide rail, a toilet seat and an arm assembly with one end connected to a hinge portion of the water storage device and the other end connected to the toilet seat, the water storage device being provided with a water tank having a water inlet and a water outlet, at the water inlet inside the water tank being provided an inlet valve having a float ball, at the water outlet inside the water tank being provided an outlet valve;

characterized in that: an opening and closing of the inlet valve is controlled by a controller, an opening and closing of the outlet valve is controlled by a rope with one end fixed and the other end connected to the outlet valve, the rope has such a length that when the water tank moves to its lowest position, the rope will open the outlet valve, and at the water outlet outside the water tank is provided an expansion discharge pipe, wherein the water storage device is further provided with a delay device for delaying the rise of the toilet seat, the delay device includes a spring, a positioning ball and a concave, and is located between movable parts comprising the water tank and a water tank support and stationary parts comprising the base of the water storage device, wherein in order to prevent the water tank from rising suddenly after the user leaves the toilet seat and causing uncomfortableness to the user, the positioning ball of the delay device will be engaged in the concave with the aid of the spring, so as to delay the rise of the toilet seat for 3-5 seconds.

* * * * *